US006260829B1

(12) United States Patent
Anderson et al.

(10) Patent No.: US 6,260,829 B1
(45) Date of Patent: Jul. 17, 2001

(54) DESIGN ENHANCEMENT DEVICE FOR ATTACHMENT TO A POST

(76) Inventors: Dennis Ronald Anderson, 1952 Rainbow Ridge, Corona, CA (US) 91720; Dale Shane Anderson, 27200 Arrow Point Trail, Corona, CA (US) 91719

( * ) Notice: Subject to any disclaimer, the term of this patent is extended or adjusted under 35 U.S.C. 154(b) by 0 days.

(21) Appl. No.: 09/327,860

(22) Filed: Jun. 8, 1999

(51) Int. Cl.[7] ..... E04C 3/30
(52) U.S. Cl. ..... 256/65; 256/66; 256/DIG. 5
(58) Field of Search ..... 256/1, 19, 22, 256/DIG. 5, 65, 66; 403/344, 331

(56) References Cited

U.S. PATENT DOCUMENTS

| | | | | |
|---|---|---|---|---|
| 2,191,444 | * | 2/1940 | Fleming | 403/344 |
| 3,023,036 | * | 2/1962 | Taylor, Jr. | 403/344 |
| 4,022,435 | | 5/1977 | Glass . | |
| 4,035,978 | * | 7/1977 | Bajorek et al. | 256/65 X |
| 4,038,802 | * | 8/1977 | Bajorek et al. | 256/22 X |
| 5,141,207 | | 8/1992 | Meglino et al. . | |
| 5,503,371 | | 4/1996 | Bies . | |
| 5,575,580 | * | 11/1996 | Parrish et al. | 256/65 X |
| 5,611,523 | | 3/1997 | Parisien . | |
| 5,622,356 | | 4/1997 | Duggan . | |
| 6,017,019 | * | 1/2000 | Erwin | 256/65 |

* cited by examiner

*Primary Examiner*—Lynne H. Browne
*Assistant Examiner*—John R. Cottingham
(74) *Attorney, Agent, or Firm*—Milord Keshishzadeh, Esq.; Milord & Associates

(57) ABSTRACT

A device that enhances the aesthetic look of preexisting post structures such as a fence, gate, railing, banister, and similar structures. The device is preferably made of two pieces and includes a cavity therebetween to accommodate the post and engage it in a frictional fashion. The device may be adorned with a variety of design elements as desired by the user. In the preferred embodiment, an attaching means may be incorporated into the two pieces to allow expeditious and cost effective attachment thereof.

14 Claims, 1 Drawing Sheet

DESIGN ENHANCEMENT DEVICE FOR ATTACHMENT TO A POST

FIELD OF THE INVENTION

This invention relates to design enhancements in ornamental iron technology and particularly to a split design enhancement device used to enclose a post or similar structure therebetween that reduces the cost of decorative enhancements of posts, fences, and similar structures.

BACKGROUND OF THE INVENTION

Fences are used to enclose property and define the boundaries thereof In addition, railings and banisters are provided within and around houses as a safety device to prevent individuals from falling from uneven floor levels and as an aid in climbing stairs. In order to fit in with the aesthetics of their surroundings, railings and similar structures are adorned with aesthetic designs.

For aesthetic purposes, decorative designs and scrolls have traditionally been formed from the same material as the fence or post structure itself, usually metal. In addition, such decorative designs have traditionally also been welded to the structure. Therefore, the aesthetic designs have traditionally been incorporated into fences, posts, railings, and gates during the fabrication process and have substantially increased the cost of such structures. Furthermore, because of the increased weight of such structures after fabrication, it has made transportation and installation more costly and cumbersome.

Aesthetic designs that can be affixed to fence structures at a post-production stage have been contemplated in the prior art. For example, U.S. Pat. No. 4,022,435 to Glass discloses a molded scroll design for fence structures that can be applied to existing structures. However, the scroll design of Glass has a complex attachment procedure that utilizes multiple parts. The device of Glass has a face plate and a back plate that need to be screwed into the scroll structure to affix the device to the fence structure. The multiplicity of parts makes the installation of Glass' device cumbersome and time consuming. Alternatively, Glass proposes a clip on apparatus that attaches to post structures. However, the clip on structure cannot sustain the weight of complex aesthetic designs and can easily be stolen by vandals.

The prior art does not address the need for a device that provides aesthetic designs for post structures that can easily be applied to pre-existing post structures in a durable yet removable fashion. Therefore, there remains a long standing and continuing need for an advance in the art of aesthetic designs for post structures that is simpler in both design and use, is more economical, sturdy, and efficient in its construction and use, and can quickly be installed onto a preexisting post structure in a sturdy fashion.

SUMMARY OF THE INVENTION

Accordingly, it is general object of the present invention to overcome the disadvantages of the prior art.

In particular, it is an object of the present invention to provide an aesthetic enhancement device for enclosing a post that is efficiently and easily attached in the field at a post production stage.

It is another object of the present invention to provide an aesthetic enhancement device for enclosing a post and similar fence structures that provides a variety of attachment means in binding the device to the post and similar structures.

It is another object of the present invention to provide an aesthetic enhancement device for enclosing a post and similar fence structures that allows painting of the device to match the color of the post and to exude an expensive design impression at a substantially reduced cost.

It is another object of the present invention to provide an aesthetic enhancement device for enclosing a post and similar fence structures that allows the use of an adhesive to securely attach the device to the post and similar structures.

It is another object of the present invention to provide an aesthetic enhancement device for enclosing a post and similar fence structures that allows interconnection of a plurality of the devices and thus increase the variety of available designs.

It is yet another object of the present invention to provide an aesthetic enhancement device for enclosing a post and similar fence structures that is economical and time saving in its construction and use.

It is a further object of the present invention to provide an aesthetic enhancement device for enclosing a post and similar fence structures that is not comprised of numerous parts and has a simple yet sturdy attachment means.

In keeping with the principles of the present invention, a unique aesthetic enhancement device that is preferably constructed of two pieces accomplishes the aforementioned objects and advantages. However, it is to be understood that the device can be made of more than just two pieces and that the pieces may be asymmetrical. Each piece of the device has a top portion, middle portion, and a base portion, and a cavity that extends axially from the center of the top portion and through the base portion. When the two pieces of the device are joined, the cavity accommodates a post or similar structure. The post may be of symmetrical shape, asymmetrical shape, or any irregular shape and the device may be modified accordingly to accommodate the variety of post designs. The walls defining said cavity being of sufficient size to accommodate the post in a frictional fashion. For a more secure engagement, an adhesive means may be applied to the interface between the walls defining the cavity and the post.

Each of the devices has a first side and a second side, and each of the first and second sides attaches to the corresponding side on each of the devices. The attaching means is preferably comprised of a pin and hole arrangement where a pin on the first device is adapted to insert into a corresponding hole on the second device and vice versa. However, an adhesive means can also be used to attach the two pieces together by applying the adhesive means to the pin directly or applying the adhesive to the walls defining the hole. Furthermore, a plurality of projections may be aligned in a backward extending manner on the pin to increase the frictional engagement between the projections and the wall defining the hole. In an alternate embodiment, the attaching means may be made of a fossa and jutting portion arrangement, wherein the fossa of each member receives the jutting portion of the other member. The two piece arrangement of the present device allows the device to be applied to a post or a similar structure without the need for tools, such as a screw-driver, wrench, and hammer.

The outer surface of the device may be adorned with a variety of designs as contemplated by the user. In addition, a plurality of the devices may be interconnected by the varying design elements to enlarge the variety of designs that may be utilized.

Such stated objects and advantages of the invention are only examples and should not be construed as limiting the present invention. These and other objects, features, aspects, and advantages of the invention herein will become more apparent from the following detailed description of the embodiments of the invention when taken in conjunction with the accompanying drawings and the claims that follow.

DETAILED DESCRIPTION OF THE INVENTION

Figure 1:
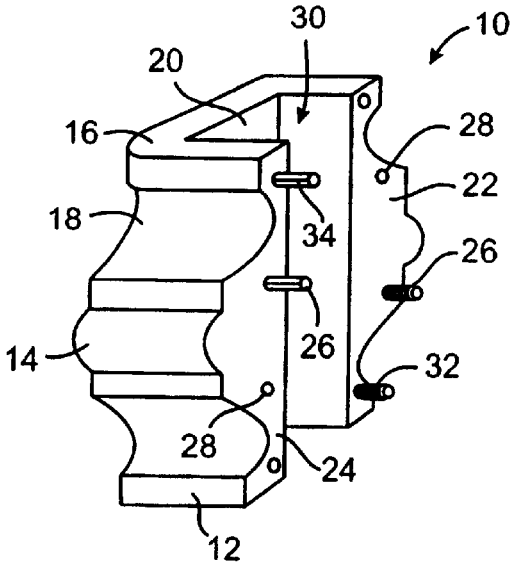
FIG. 1 is a perspective view of a first member of the design enhancement device.

Referring to FIG. 1, therein is illustrated a first member of a design enhancement device 10 and it is to be understood that a second member of device 10 is preferably similarly shaped, however, it is to be understood that the two pieces may be asymmetrical. Device 10 may be made of varying sizes and shapes to enclose objects of varying sizes and shapes. In addition, device 10 may be constructed of a variety of materials such as, but not limited to plastics, resins, wood, and metal, and can be constructed from a variety of methods that are known in the art such as, but not limited to, injection molding. Device 10 has a base portion 12, a middle portion 14, and a top portion 16 each portion being interconnected respectively. Device 10 has an outer surface 18 and an inner surface 20. In addition, device 10 has a first side 22 and a second side 24. Each of said sides 22 and 24 has at least a protrusion 26 extending therefrom in a perpendicular fashion. Each of said sides 22 and 24 defines at least a cavity 28 perpendicular thereto, and cavity 28 is adapted to removably, yet securely, receive protrusion 26 from the opposing device 10. The plurality of cavities 28 and protrusions 26, may be arranged as shown in FIG. 1 so that only one mold need be utilized to make device 10. However, the cavities 28 and protrusions 26 may also be arranged such that two distinct molds are necessary to make a first and second member of device 10. Device 10 also defines a channel 30 that extends substantially axially from top portion 16 through base portion 12.

Protrusion 26 may have at least a laterally projecting engagement means 32, engagement means 32 being of sufficient size to fit into the corresponding cavity 28 and to frictionally engage side 22 defining said cavity 28. Engagement means 32 may also be angled in a backward direction to make disengagement thereof more difficult and to ensure secure attachment. In addition, at least a track 34 may be provided on an outer surface of protrusion 26 and running axial thereto that will permit adhesive material to be used in inserting protrusion 26 into cavity 28, thereby assuring a more secure engagement of first and second devices 10.

Figure 2:
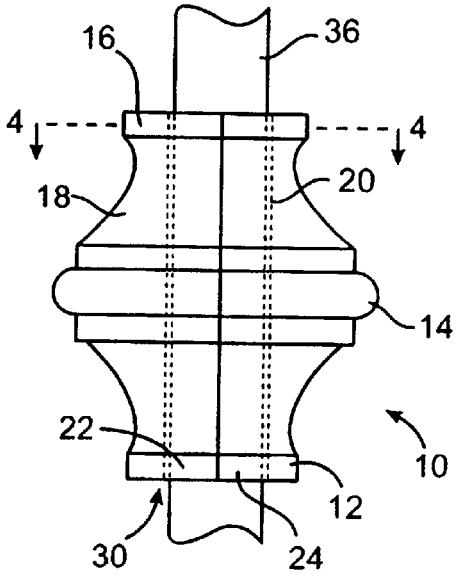
FIG. 2 is an elevational view of the design enhancement device attached to a post structure.
Figure 3:
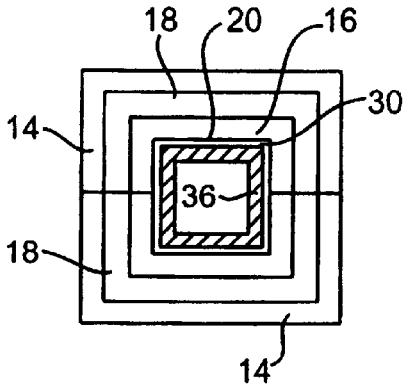
FIG. 3 is a plan view of the design enhancement device attached to a post.

Also referring now to FIGS. 2 and 3, a post 36 or similar structure is received within channel 30 of said first and second member of said device and enclosed therein when first and second members of device 10 are engaged. A water proof sealant may be used to seal the gap between top portion 16 and post 36 to prevent moisture from running down post 36 and inner surface 20 of device 10. After first and second members of device 10 are engaged, inner surface 20 defining channel 30 frictionally engages post 36. For more permanent attachment of device 10 to post 36, an adhesive means may be applied to inner surface 20 defining channel 30 to securely engage post 36 therein.

Figure 4:
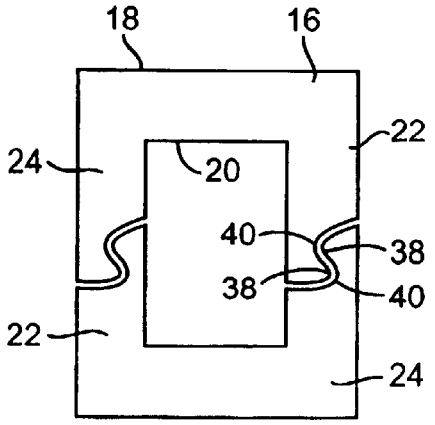
FIG. 4 is a cross sectional view of the design enhancement device with an alternate method of engagement taken along line 4—4 of FIG. 2 looking in the direction of the arrows.

Now also referring to FIG. 4, a cross section of top portion 16 is illustrated showing an alternate method of engagement between first member and second member of device 10. Each of said sides 22 and 24 has a jutting portion 38 and a fossa 40. Jutting portion 38 of first side 22 is received by fossa 40 of second side 24, in addition, jutting portion 38 of second side 24 is received by fossa 40 of first side 22, thereby first and second devices 10 engage one another in a secure, yet removable, fashion.

Figure 5:
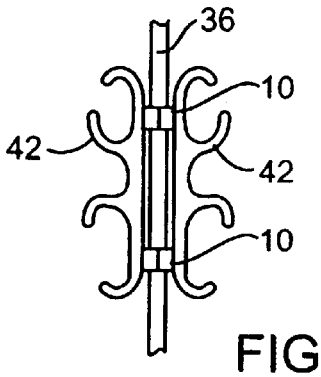
FIG. 5 is an elevational view of a plurality of the design enhancement devices interconnected by an alternate design structure and attached to a post structure.

It is to be understood that although a specific aesthetic design is illustrated on outer surface 18 of device 10, many other design variations are possible and are encompassed within the scope of the present invention. Now also referring to FIG. 5, a plurality of devices 10 may be interconnected by a design element 42. The use of a plurality of devices 10 allows attachment of more complex aesthetic designs. It is also to be understood that although a specific design element 42 is illustrated, many other design variations and alternate interconnections of devices 10 are also possible.

While the above description contains many specificities, these should not be construed as limitations on the scope of the invention, but rather as an exemplification of one preferred embodiment thereof. Many other variations are possible without departing from the essential spirit of this invention. Accordingly, the scope of the invention should be determined not by the embodiment illustrated, but by the appended claims and their legal equivalents.

What is claimed is:

1. A device, comprising:

at least a first piece and a second piece;

each of said pieces having an inner surface and an outer surface;

each of said pieces also having a base portion, a middle portion, a top portion interconnected respectively, and each of said pieces further having a first side and a second side that extend therefrom;

a first edge and a second edge being distally positioned on each of said first side and second side respectively;

said first edge and said second edge of said first piece being adapted to abut a respective said first edge and said second edge of said second piece such that a cavity is defined substantially axially therein and extends from said top portion through said base portion;

said inner surface defining said cavity frictionally engaging a post in a secure manner;

an attaching means further comprising at least a protrusion that extends from said first edge of said first piece is insertable into an aperture defined by said second edge of said second piece to bind said pieces together in a secure yet removable fashion.

2. The device of claim 1, wherein an adhesive means is applied to said inner surface and post junction to secure said device to said post in a secure fashion.

3. The device of claim 1, wherein a plurality of said promotions and said apertures are dispersed along said sides of said pieces.

4. The device of claim 1, wherein an adhesive means is applied to said protrusion to securely yet removably maintain said protrusion within said aperture defined by said side.

5. The device of claim 1, wherein at least a substantially annular projection extends, laterally from said protrusion to securely yet removably maintain said protrusion within said aperture defined by said side.

6. The device of claim 5, wherein a plurality of said projection are located on said protrusion and extends in a backward direction at an acute angle.

7. The device of claim 1, wherein at least a channel extends axially along a top surface of said protrusion.

8. The device of claim 1, wherein said pieces are made of a plurality of sizes and shapes to accommodate a plurality of posts of varying sizes and shapes.

9. The device of claim 1, wherein a plurality of aesthetic designs are applicable to said outer surface.

10. The device of claim 1, wherein said device is constricted of a material selected from the group consisting of at least a metal, wood, resin, plastic, and carbon based polymeric materials.

11. The device of claim 1 wherein a plurality of said devices are interconnected to create additional designs.

12. The device of claim 1, wherein a color coating is applicable to said device to match a color on said post.

13. A device used to enhance the aesthetic appearance of a post, a fence, a railing, a banister, and similar structures, comprising:

at least a first member and a second member;

an inner surface and an outer surface existing on both said first member and second member;

a base portion, a middle portion, a top portion, a first side and a second side extending from said inner surface of said first member and said second member respectively;

said first side and said second side each defining an edge distal to said inner surface;

a cavity positioned between said inner surface and said first side and said second side and axially extending from said top portion rough said base portion;

an attaching means further comprising at least a male and female component located on said edges of said first and second sides of respective first and second members to securely, yet removably, attach said first member to said second member and enclose said post therebetween in an efficient yet secure manner.

14. A device used to enhance the aesthetic appearance of a post, a fence, a railing, a banister, and similar structures, comprising:

at least a first member and a second member;

a panel having a first side and a second side extending therefrom and said first side and said second side being in substantially parallel relations;

a respective first edge and a second edge being located on said respective first side and second side distal to said panel;

an inner surface and an outer surface existing on both said first member and second member;

a base portion, a middle portion, and a top portion being contained on said first member and said second member respectively;

a cavity axially extending from said top portion through said base portion and defined by said first side, said panel, and said second side;

a protrusion extending from said first edge of said first member;

an aperture being defined on said second edge of said second member, said aperture receiving said protrusion dextrin such that the first and second edges of said first member abut the first and second edges of said second member to enclose said post therebetween in a secure yet removable manner.

* * * * *